US012059061B2

(12) United States Patent
Wu

(10) Patent No.: US 12,059,061 B2
(45) Date of Patent: Aug. 13, 2024

(54) PULL-TAB EXTENDER AND METHODS OF USE

(71) Applicant: Mcraft Leather LLC, Bolingbrook, IL (US)

(72) Inventor: Min Wu, Bolingbrook, IL (US)

( * ) Notice: Subject to any disclaimer, the term of this patent is extended or adjusted under 35 U.S.C. 154(b) by 155 days.

(21) Appl. No.: 17/741,428

(22) Filed: May 10, 2022

(65) Prior Publication Data

US 2023/0363500 A1 Nov. 16, 2023

(51) Int. Cl.
*A44B 19/26* (2006.01)

(52) U.S. Cl.
CPC ..... *A44B 19/262* (2013.01)

(58) Field of Classification Search
CPC .... A44B 19/262; A44B 19/26; Y10T 24/2586
See application file for complete search history.

(56) References Cited

U.S. PATENT DOCUMENTS

| | | | | |
|---|---|---|---|---|
| 6,581,254 | B1 * | 6/2003 | Tang | A44B 19/262 24/429 |
| 10,188,180 | B2 * | 1/2019 | Yamagishi | A44B 19/26 |
| 2008/0196217 | A1 * | 8/2008 | Eschbach | A44B 19/262 24/386 |
| 2008/0252461 | A1 * | 10/2008 | Sugata | G06K 19/04 340/572.1 |
| 2009/0056086 | A1 * | 3/2009 | Ujihara | A44B 19/26 24/429 |

* cited by examiner

*Primary Examiner* — Robert Sandy
*Assistant Examiner* — Louis A Mercado
(74) *Attorney, Agent, or Firm* — Jonathan Torchman; Torchman IP LLC

(57) ABSTRACT

Embodiments described herein include an attachment, protector, and/or extender for a pull-tab or zipper pull. The extender may be made out of two elongated tabs or sides from one continuous piece of fabric, leather, or other natural or synthetic material. The material may include a central planar body with an a proximal and a distal aperture. The tabs may loop over one another when fully prepared and covering the pull-tab to make a clean and aesthetic look. The looping steps of first and second elongated tabs provides for receiving the pull-tab of the closure device or zipper at the central planar body of the extender for users operating while enhancing and protecting zipper closures and the like.

20 Claims, 9 Drawing Sheets

PULL-TAB EXTENDER AND METHODS OF USE

BACKGROUND

In the designer handbag industry many consumers are known to acquire accessories to fashion and personalize their handbags to be used after purchase. Accessories may include decorative tags, tassels, leather straps, etc. The zipper of the designer handbags may be a popular area for fashionable modification and customization. Modern zippers are frequently small or hard to grasp and also often need extra protection or cover. There is a need therefore for a new device and/or technique for covering zippers in handbags and other accessories to make them more attractive and easier to use.

BRIEF SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "certain embodiments" may be used herein to refer to a single embodiment or multiple embodiments of the disclosure.

In one aspect, a Pull-tab Extender includes a central planar body element having a proximal end and distal end, the central planar body element defining a first aperture and a second aperture thereon, a first elongated tab at the distal end of the central planar body element, a second elongated tab at the proximal end of the central planar body element and proximate to the second aperture, the first elongated tab being longer than the second elongated tab with the first elongated tab being positioned at the central planar body element closer to the first aperture than the second aperture, the first aperture being intermediate to the central planar body element, and where the second aperture can accommodate a thickness of the second elongated tab, and the first aperture can accommodate a thickness of both the first and second elongated tabs.

The Pull-tab Extender may be such as where the second aperture is at least as large as the thickness of the second elongated tab, and the first aperture is at least as large as a thickness of both the first and second elongated tabs.

The Pull-tab Extender may be such as where the first aperture is near centered relative to the central planar body element.

The Pull-tab Extender may be such as where the second elongated tab is looped back and into the first aperture.

The Pull-tab Extender may also be such as where the central planar body element is enabled to be received at a pull-tab of a closure device and the pull-tab of the closure device is a zipper.

The Pull-tab Extender may also be such as where the first elongated tab and second elongated tab are tapered toward the central planar body element.

The Pull-tab Extender may also be such as where the Pull-tab Extender is made of an expandable material and the second aperture is expanded to accommodate the thickness of the second elongated tab, and the first aperture is expanded to accommodate the thickness of both the first and second elongated tabs.

The Pull-tab Extender may also be such as where magnets are located within the first and second elongated tabs and are used to clasp the first elongated tab to the second elongated tab at the point(s) of the magnets so that the tabs are in better or full alignment. Other technical features may be readily apparent to one skilled in the art from the following figures, descriptions, and claims in order to create full alignment of the tabs.

In one aspect, the first elongated tab is looped back over the second elongated tab, into the second aperture and then into and through the first aperture.

The pull-tab may also be such as where the first and second elongated tabs are at equal lengths when fully looped through the first and second apertures. Other technical features may be readily apparent to one skilled in the art from the following figures, descriptions, and claims.

In one aspect, a Pull-tab Extender includes a central planar body element having a proximal end and distal end, the central planar body element defining a first aperture and a second aperture thereon, a first elongated tab at the distal end of the central planar body element, a second elongated tab at the proximal end of the central planar body element and proximate to the second aperture, the first elongated tab being longer than the second elongated tab with the first elongated tab being positioned at the central planar body element closer to the first aperture than the second aperture, the first aperture being intermediate to the central planar body element, and where the second aperture can accommodate a thickness of second elongated tab, and the first aperture can accommodate a thickness of both the first and second elongated tabs.

The Pull-tab Extender also includes the second elongated tab being looped back and into the first aperture and the first elongated tab being looped back over the second elongated tab, into the second aperture and then into and through the first aperture.

The Pull-tab Extender may also be such as where the first and second elongated tabs are at equal lengths when fully looped through the first and second apertures.

The Pull-tab Extender may also be such as where the central planar body element is enabled to be received at a pull-tab of a closure device. Other technical features may be readily apparent to one skilled in the art from the following figures, descriptions, and claims.

In one aspect, a Pull-tab Extender method, includes the steps of providing a planar body element having a proximal end and distal end, defining a first aperture and a second aperture into and through the body element and positioned thereon, with the first aperture being positioned close to the proximal end of said body element, the second aperture being positioned intermediate said body element and closer to the distal end of said body element than the first aperture positioning relative to the distal end of said body element, extending a first elongated tab from the proximal end of said body element, and extending a second elongated tab from the distal end of said body element, the second tab being longer than the first tab, where the second aperture being able to accommodate a thickness of both first elongated tab and second elongated tab.

The Pull-tab Extender method further includes the steps of looping the second elongated tab into the first aperture and looping the first elongated tab over the second elongated tab, directing the first elongated tab into the second aperture and into the first aperture with the second elongated tab.

The pull-tab of method may include the extending steps of the respective first and second elongated tabs provide the first and second elongated tabs as integral with the body element. Other technical features may be readily apparent to one skilled in the art from the following figures, descriptions, and claims.

The Pull-tab Extender may also be such as where the closure device fits through the first aperture as well as the first elongated tab and the second elongated tab.

The pull-tab may also be such as where the closure device fits through the second aperture as well as the first elongated tab and the second elongated tab.

The pull-tab of method may have the first and second elongated tabs at equal lengths when fully looped through the first and second apertures.

The Pull-tab Extender method may also be such as where the looping steps of first and second elongated tabs receives a pull-tab of a closure device at the central planar body element for use therewith. Other technical features may be readily apparent to one skilled in the art from the following figures, descriptions, and claims.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

The foregoing and other objects, features and advantages will become apparent and more readily appreciated from the following detailed description taken in conjunction with the accompanying drawings, in which.

DETAILED DESCRIPTION

Figure 1:
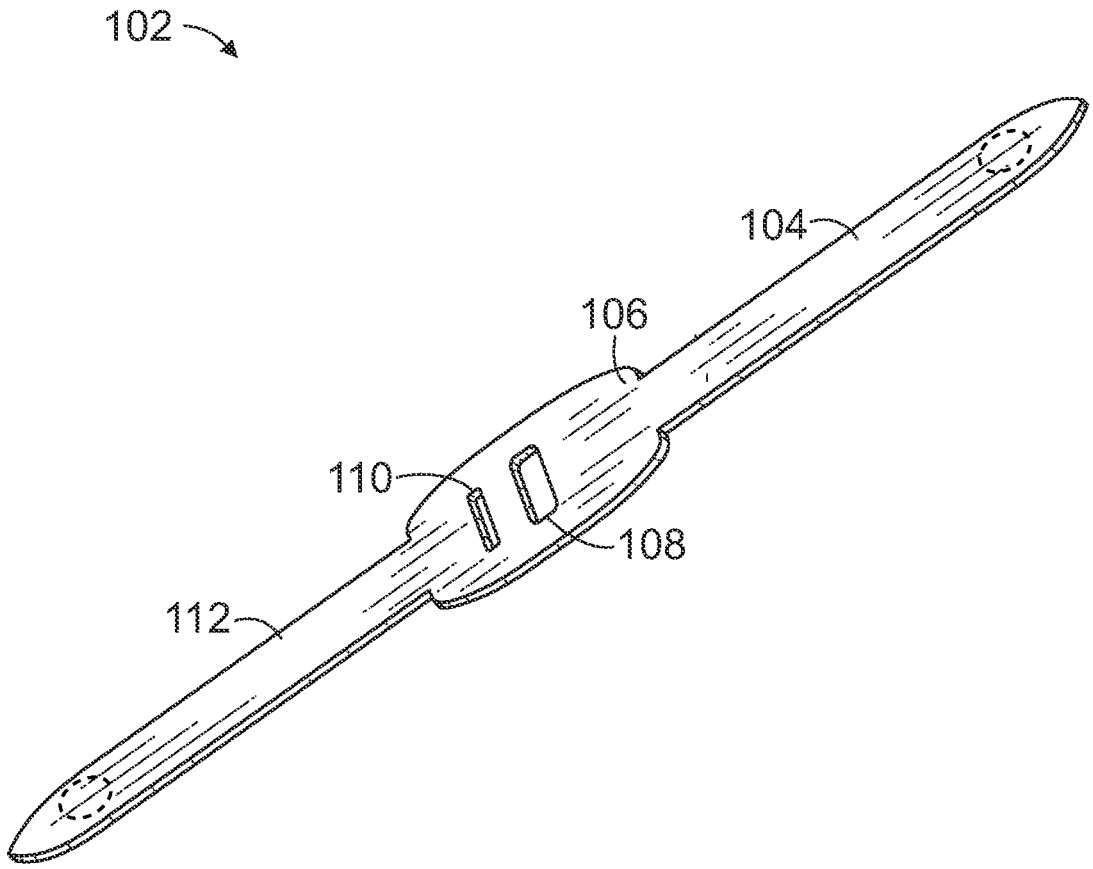
FIG. 1 illustrates an isometric view of a Pull-tab Extender according to one embodiment.

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

It is important to note that the embodiments disclosed by the invention are only examples of the many advantageous uses of the innovative teachings herein. In general, statements made in the specification of the present application do not necessarily limit any of the various claims.

Embodiments of the present invention include novel ways of functionally and decoratively covering pull-tabs including zipper pulls, in garments, purses, handbags, etc. In the luxury handbag market many men and women are interested in distinguishing their purses, luggage, wallets, etc. While pull-tabs are used for most of the fashion and handbag market, not many after market or accessory implementations exist for protecting and decorating pull-tabs. There exists a need accordingly for implementable devices to fashion over pull-tabs, extend, and protect them and create an ornamental functional enhancement.

Embodiments include ways of looping a Pull-tab Extender with two sides or tabs that can loop over the Pull-tab Extender. The Pull-tab Extender is made in such a way that one tab may be slightly longer than the other tab. The Pull-tab Extender may have a central planar body element made up of an unlimited variety of ornamental and protective designs. The looping steps of first and second elongated tabs provides for receiving the pull-tab of the closure device or zipper at the central planar body of the extender for users operating while enhancing and protecting zipper closures and the like. The central planar body element may include two apertures, where one aperture can accommodated, and in some instances, has at least the width of the two tabs, and is intermediate or near centered in the central planar body element. The second aperture may be closer to the shorter tab. The lengths of the tabs may not be easily noticeable as being different when the Pull-tab Extender is standing alone and not attached to the Pull-tab Extender.

Once placed on the pull-tab and/or zipper, the smaller tab may loop through the first aperture. The larger tab may then loop back around and under the smaller tab. Once looped around the larger tab may be weaved into the second aperture and then through the first aperture. The larger tab may be pulled through, meeting the smaller tab at the same final point to make a balanced Pull-tab Extender.

In some embodiments, a design decision may make it desirable to have the tabs not fully balanced depending on the purse, handbag, luggage, etc. For example, it may be aesthetic for one tab to be slightly longer when finally pulled through. Once established on the pull-tab, the Pull-tab Extender may fully or partially hide the pull-tab making the pull-tab or zipper look like more of a fabric or leather pull. The fabric for the zipper protector may be canvas, textile, leather, vinyl, Polyvinyl Chloride (PVC), jute, hemp, bamboo, synthetic or artificial leather, cork leather, microfiber, ocean leather, etc.

FIG. 1 illustrates an isometric view of a Pull-tab Extender according to one embodiment. The Pull-tab Extender Embodiment 102 may include a First Elongated Tab 104, a Central Planar Body Element 106, a First Aperture 108, a Second Aperture 110, and a Second Elongated Tab 112. In order for correct looping and protection of the Pull-tab, First Elongated Tab 104 may be slightly longer than Second Elongated Tab 112. Additionally First Aperture 108 may be at least the width of both First Elongated Tab 104 and Second Elongated Tab 112 because two loops of the tabs may be put through First Aperture 108. In some embodiments, the Pull-Tab Extender may include magnets inside the fabric as indicated by the dashed circles, for example.

The design and implementation of each set of apertures may be created for each designer pull-tab and/or zipper. For example, a First Aperture 108 may be 1 cm in width to accommodate twice the thickness of the fabric used for the Pull-tab Extender. In another embodiment, the First Aperture 108 may be 2.5 cm in order to accommodate the twice the thickness of the fabric used in addition to leaving space for the zipper itself to be jettisoned through the aperture. The manufacture of the aperture size may be determined by thickness, fragility and tautness of the fabric as well as how tight or loose the Pull-tab Extender is designed relative to the bag/luggage and zipper pulls or pull-tab.

In yet another embodiment the First Aperture 108 may accommodate the thickness of both First Elongated Tab 104 and Second Elongated Tab 112 by using an expandable material such as silicone. The First Aperture 108 and Second Aperture 110 in this case may be more narrow than the actual thickness of the tabs and may be accounted for expandability. Lycra and spandex are two other exemplary stretchable materials that can be used to accommodate the sizes of the First Elongated Tab 104 and Second Elongated Tab 112.

Figure 2:
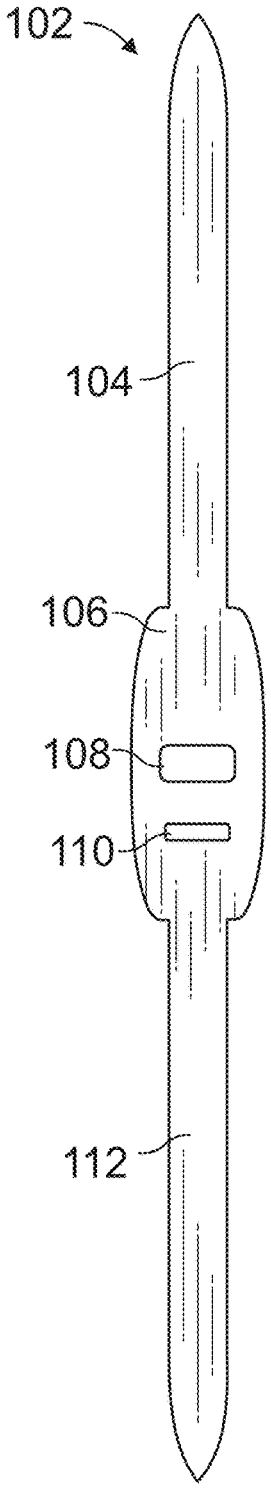
FIG. 2 illustrates a front view of a Pull-tab Extender according to one embodiment.

FIG. 2 illustrates a front view of a Pull-tab Extender according to one embodiment. The system comprises a Pull-tab Extender Embodiment 102, a First Elongated Tab 104, a Central Planar Body Element 106, a First Aperture 108, a Second Aperture 110, and a Second Elongated Tab 112.

Figure 3:
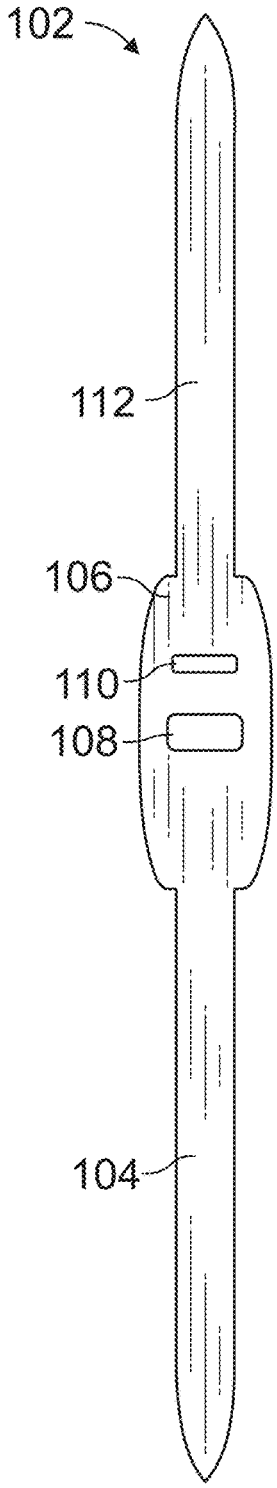
FIG. 3 illustrates an isometric view of one embodiment.

FIG. 3 illustrates an isometric view of one embodiment. The system comprises a Pull-tab Extender Embodiment 102, a First Elongated Tab 104, a Central Planar Body Element 106, a First Aperture 108, a Second Aperture 110, and a Second Elongated Tab 112.

Figure 4:
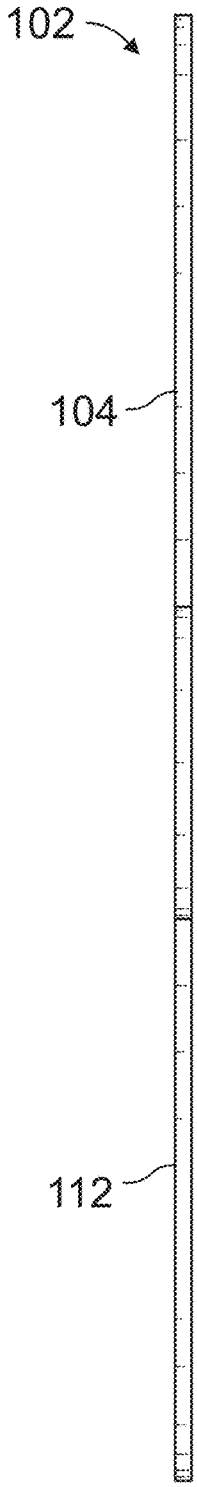
FIG. 4 illustrates a side view of one embodiment.

FIG. 4 illustrates a side view of one embodiment. The system comprises a Pull-tab Extender Embodiment 102, a First Elongated Tab 104, and a Second Elongated Tab 112.

Figure 5:
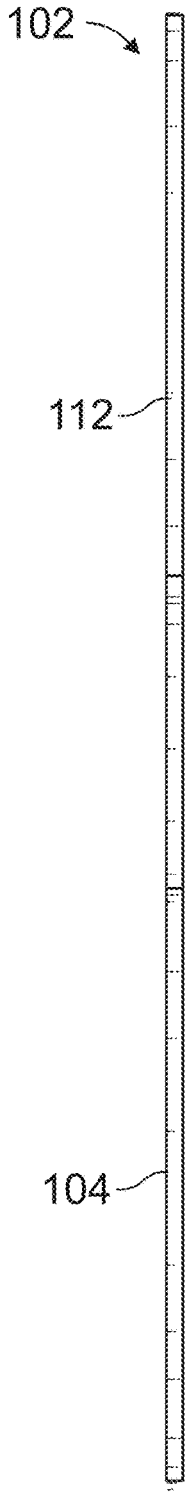
FIG. 5 illustrates a side view of one embodiment.

FIG. 5 illustrates a side view of one embodiment. The system comprises a Pull-tab Extender Embodiment 102, a First Elongated Tab 104, and a Second Elongated Tab 112.

Figure 6:
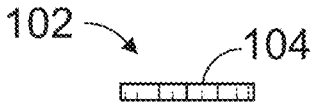
FIG. 6 illustrates an isometric view of one embodiment.

FIG. 6 illustrates an isometric view of one embodiment. The system comprises a Pull-tab Extender Embodiment 102 and a First Elongated Tab 104.

Figure 7:
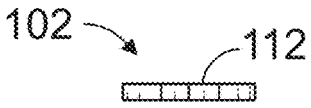
FIG. 7 illustrates an isometric view of one embodiment.

FIG. 7 illustrates an isometric view of one embodiment. The system comprises a Pull-tab Extender Embodiment 102 and a Second Elongated Tab 112.

Figure 8:
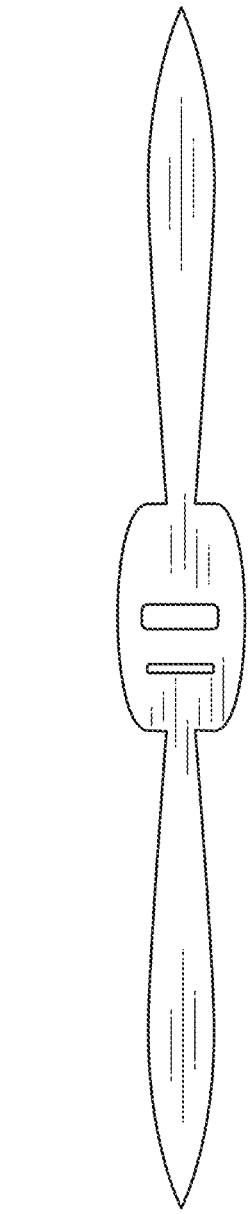
FIG. 8 illustrates a front view of a Pull-tab Extender Embodiment.

FIG. 8 illustrates a front view of Pull-tab Extender Embodiment 802. Pull-tab Extender Embodiment 802 includes two tapered tabs with narrower width near the central planar body element and toward the ends of the elongated tabs. As can be seen the first aperture in the middle of Pull-tab Extender Embodiment 802 is exactly or nearly centered. Depending on the design of the fabric, tab length, and zipper pull size the first aperture may be approximately or substantially, for example 85-100% centered in the Pull-tab Extender Embodiment 802. The placement of the second aperture may be between the edge of the Protector Body Center and the smaller tab. As illustrated the second aperture is roughly the size of the thickness of the fabric or leather. The tabs may be separate units and attached via a hinge or sewn on.

Figure 9:
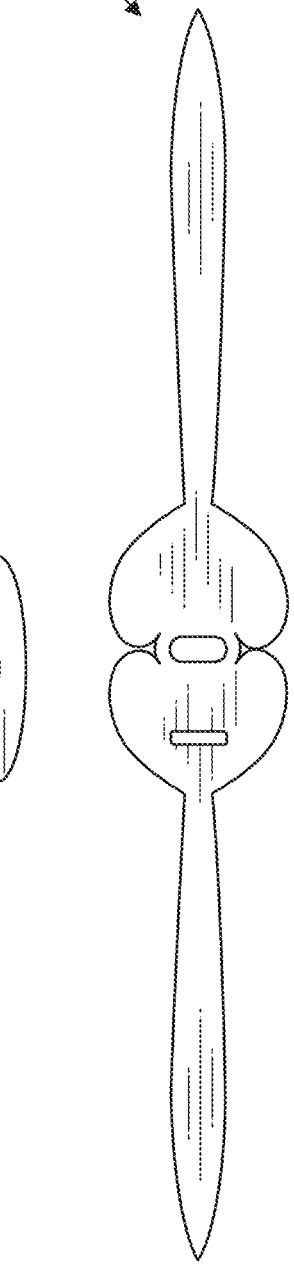
FIG. 9 illustrates a front view of a Pull-tab Extender Embodiment.

FIG. 9 illustrates a front view of Pull-tab Extender Embodiment 902. The central planar body element is designed in the shape of a heart or a clover leaf as illustrated. In Pull-tab Extender Embodiment 902 the first aperture is more rounded, and narrower and larger in this example. As illustrated, the zipper or pull-tab to be used with the Pull-tab Extender Embodiment 902 may be smaller, rounder or differently shaped in this or the other embodiments.

Figure 10:
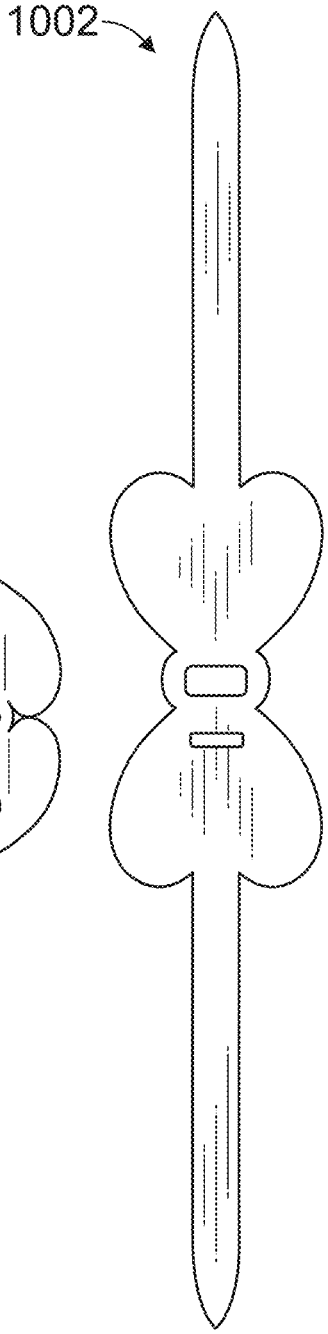
FIG. 10 illustrates a front view of a Pull-tab Extender Embodiment.

FIG. 10 illustrates a front view of Pull-tab Extender Embodiment 1002. Pull-tab Extender Embodiment 1002 includes two tabs with equal width across the tabs ending in a point which can be used for threading through each of the two apertures. The shape of the central planar body element is similar to two hearts or a cloverleaf. Any variation on the design of the central planar body element can be imagined within the scope of the art. The tabs are flattened or non-tapered in this exemplary embodiment. Similarly the second aperture is closer to the first aperture relative to the body center as compared to the other exemplary embodiments.

Figure 11:
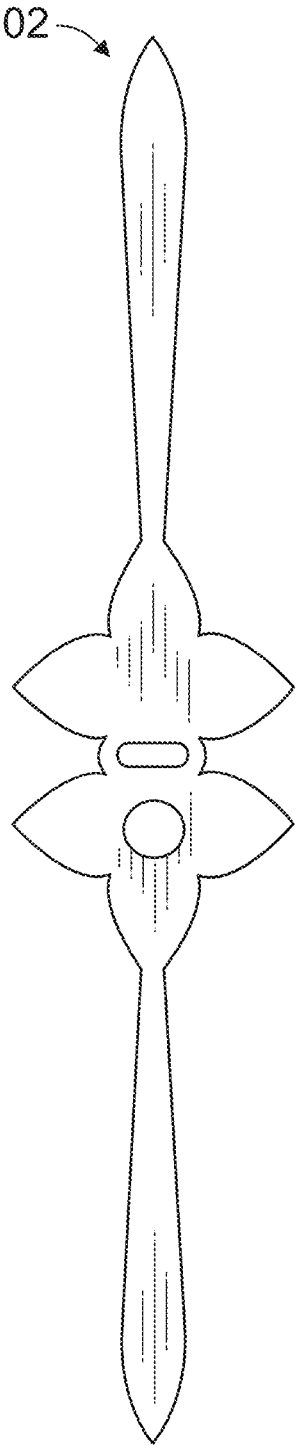
FIG. 11 illustrates a front view of a Pull-tab Extender Embodiment.

FIG. 11 illustrates a front view of Pull-tab Extender Embodiment 1102. The second aperture in Pull-tab Extender Embodiment 1102 is in the shape of a circle and in this case larger than the centered aperture, illustrating that a variety of design formats may be made. The centered aperture is elliptical in shape.

Figure 12:
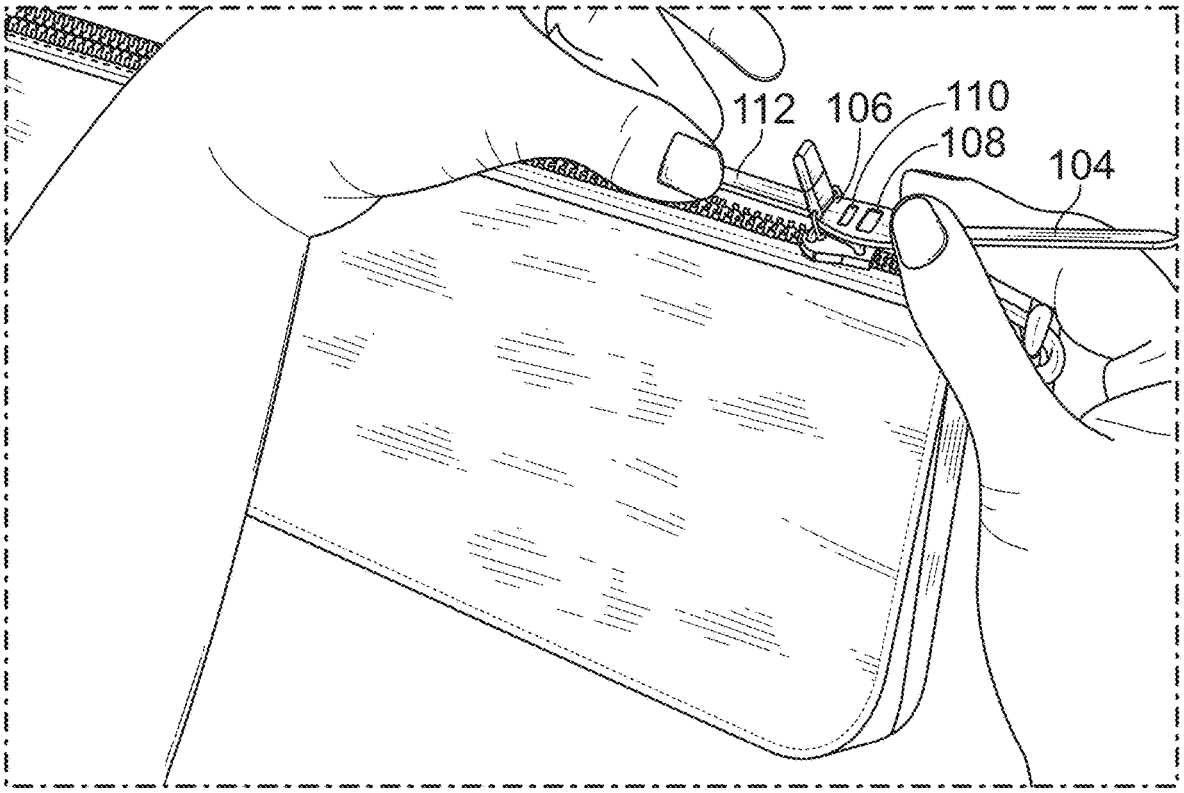
FIG. 12 illustrates an attachment method step according to an exemplary embodiment.

FIG. 12 illustrates an attachment method step according to an exemplary embodiment. The system comprises a First Elongated Tab 104, a Central Planar Body Element 106, a First Aperture 108, a Second Aperture 110, and a Second Elongated Tab 112. As can be seen in FIG. 12 a user may thread Second Elongated Tab 112 into the bottom of the zipper/pull-tab, or through an aperture within the zipper/pull-tab. This can be the first step in the process of weaving the Pull-tab Extender through the zipper or pull-tab. The width of the pull-tab and Pull-tab Extender can vary. Therefore, the width of the Second Elongated Tab 112 may be made to be smaller than the width of the aperture in the zipper/pull-tab so that the zipper pull attachment can weave through it as illustrated. In some embodiments, Second Elongated Tab 112 may be weaved through the middle or a higher point in the zipper/pull-tab.

Figure 13:
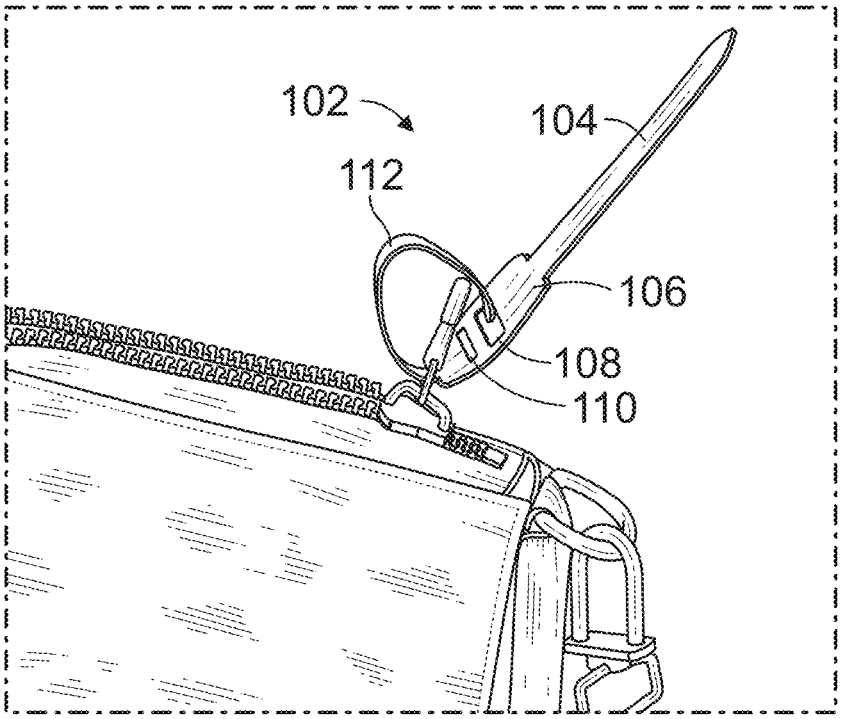
FIG. 13 illustrates an attachment method step according to an exemplary embodiment.

FIG. 13 illustrates an attachment method step according to an exemplary embodiment. The system comprises a Pull-tab Extender Embodiment 102, a First Elongated Tab 104, a Central Planar Body Element 106, a First Aperture 108, a Second Aperture 110, and a Second Elongated Tab 112. In FIG. 13 we can see how Second Elongated Tab 112 is about to go into First Aperture 108. First Elongated Tab 104 can be grasped, to pull up the Pull-tab Extender in order to access First Aperture 108. At the end of this step the Second Elongated Tab 112 will be weaved through First Aperture 108.

Figure 14:
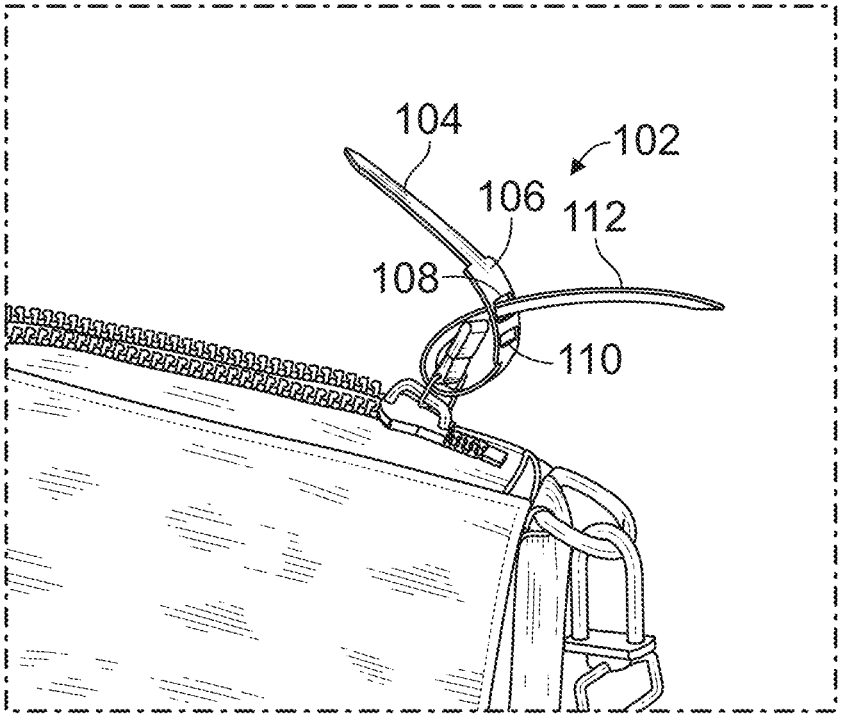
FIG. 14 illustrates an attachment method step according to an exemplary embodiment.

FIG. 14 illustrates an attachment method step according to an exemplary embodiment. The system comprises a Pull-tab Extender Embodiment 102, a First Elongated Tab 104, a Central Planar Body Element 106, a First Aperture 108, a Second Aperture 110, and a Second Elongated Tab 112. In FIG. 14 we can see how Second Elongated Tab 112 has been extended through First Aperture 108. Next the First Elongated Tab 104 will be looped back around and under Second Elongated Tab 112 to be looped back up and into Second Aperture 110. In the looping, First Elongated Tab 104 will be weaved through the bottom or accessible portion of the zipper or pull-tab.

Figure 15:
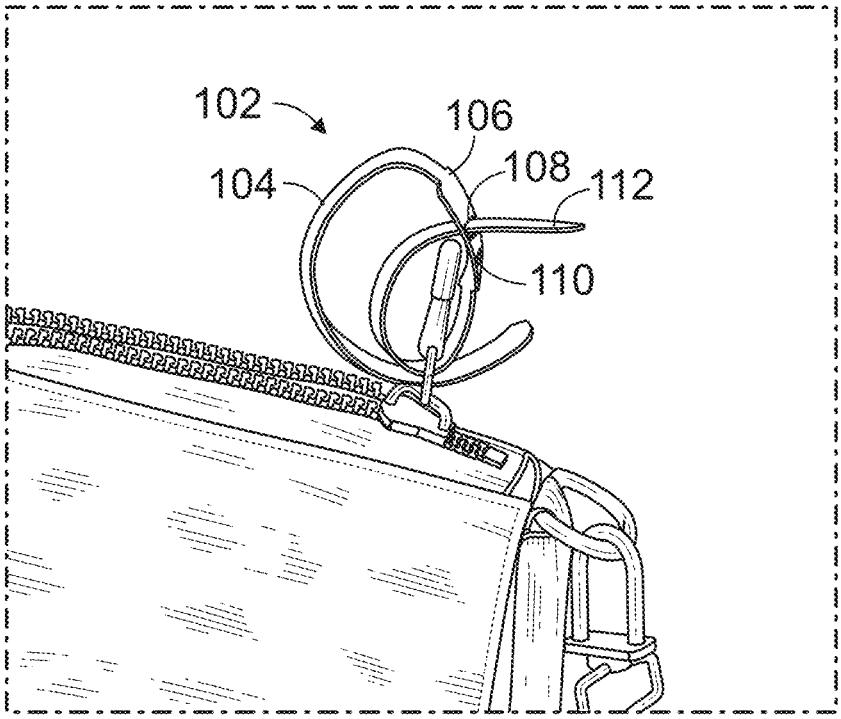
FIG. 15 illustrates an attachment method step according to an exemplary embodiment.

FIG. 15 illustrates an attachment method step according to an exemplary embodiment. The system comprises a Pull-tab Extender Embodiment 102, a First Elongated Tab 104, a Central Planar Body Element 106, a First Aperture 108, a Second Aperture 110, and a Second Elongated Tab 112. In FIG. 15, we can see how Second Elongated Tab 112 is extended through the top via the First Aperture 108. On the bottom we can see First Elongated Tab 104 being curved and pulled through the aperture in the zipper/pull-tab that enables access for the Pull-tab Extender. This aperture in the zipper/pull-tab may be at any point, orientation or size in the zipper pull or pull-tab. Similarly, the design of the tabs may be made to be customized for different sized zipper pulls and apertures within the zipper pulls. In the next step First Elongated Tab 104 will be weaved through Second Aperture 110.

Figure 16:
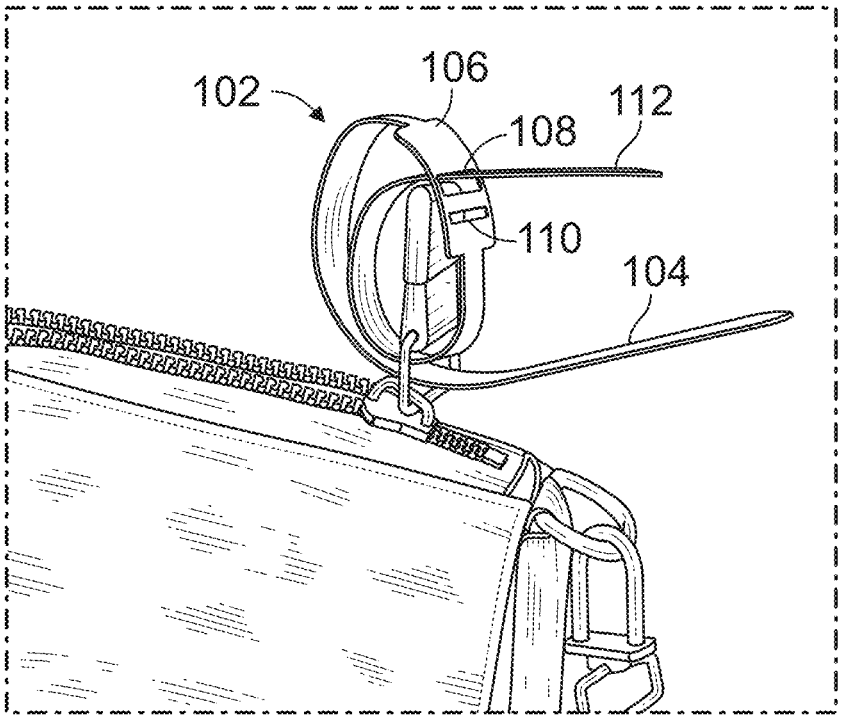
FIG. 16 illustrates an attachment method step according to an exemplary embodiment.

FIG. 16 illustrates an attachment method step according to an exemplary embodiment. The system comprises a Pull-tab Extender Embodiment 102, a First Elongated Tab 104, a Central Planar Body Element 106, a First Aperture 108, a Second Aperture 110, and a Second Elongated Tab 112. FIG. 16 includes an angled view where we can see Second Elongated Tab 112 extended through First Aperture 108 and then we see First Elongated Tab 104 being able to be grasped, in order to be pulled through Second Aperture 110 and then First Aperture 108 in the subsequent attachment method step.

Figure 17:
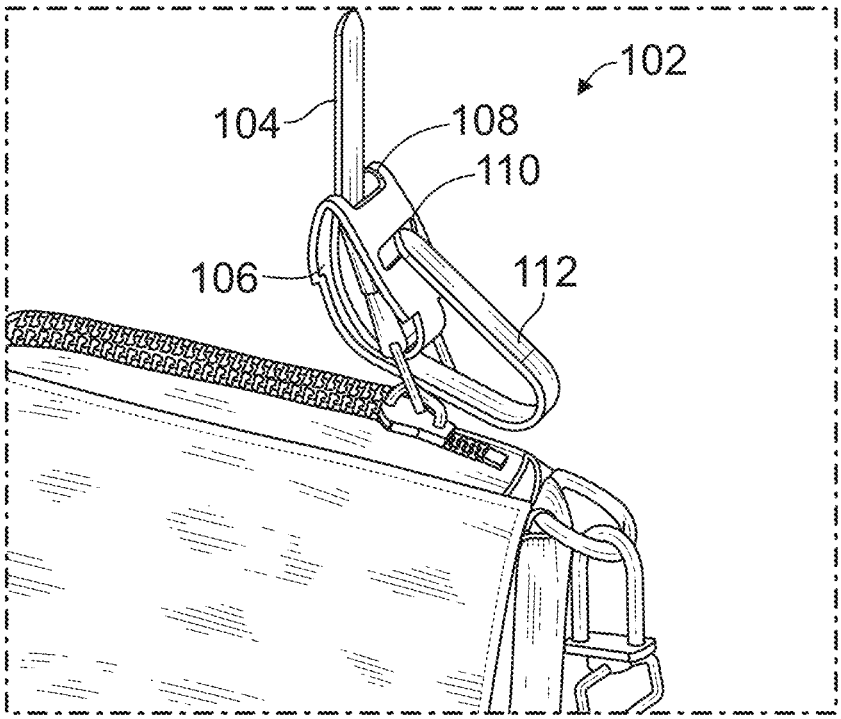
FIG. 17 illustrates an attachment method step according to an exemplary embodiment.

FIG. 17 illustrates an attachment method step according to an exemplary embodiment. The system comprises a Pull-tab Extender Embodiment 102, a First Elongated Tab 104, a Central Planar Body Element 106, a First Aperture 108, a Second Aperture 110, and a Second Elongated Tab 112. In FIG. 17 we see First Elongated Tab 104 being about to be threaded through Second Aperture 110. When there is space in the design for the zipper or pull-tab to be pulled through First Aperture 108 as well, First Elongated Tab 104 will be on one side of the zipper or pull-tab and Second Elongated Tab 112 will be on the other side, once pulled through.

Figure 18:
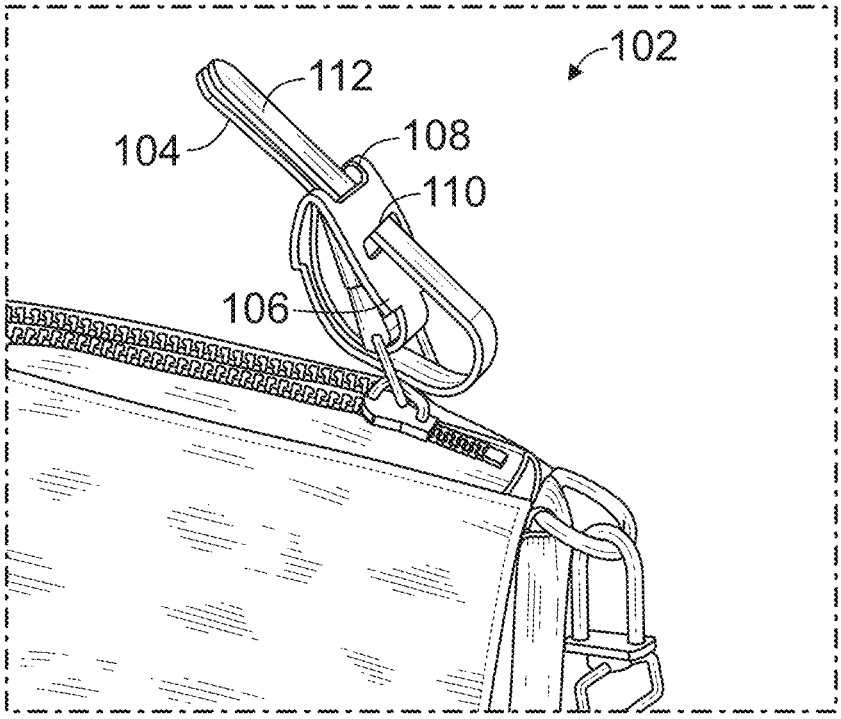
FIG. 18 illustrates an attachment method step according to an exemplary embodiment.

FIG. 18 illustrates an attachment method step according to an exemplary embodiment. The system comprises a Pull-tab Extender Embodiment 102, a First Elongated Tab 104, a Central Planar Body Element 106, a First Aperture 108, a Second Aperture 110, and a Second Elongated Tab 112. In FIG. 18 we see how First Elongated Tab 104 has now been threaded through first Second Aperture 110 and then First Aperture 108. It will then become the same proportional distance so that the ends of First Elongated Tab 104 and Second Elongated Tab 112 meet when the tabs are tightened in FIG. 19. There can be slack as illustrated while weaving through the various apertures. In some embodiments the lengths of the tabs may be more closely aligned in this stage.

Figure 19:
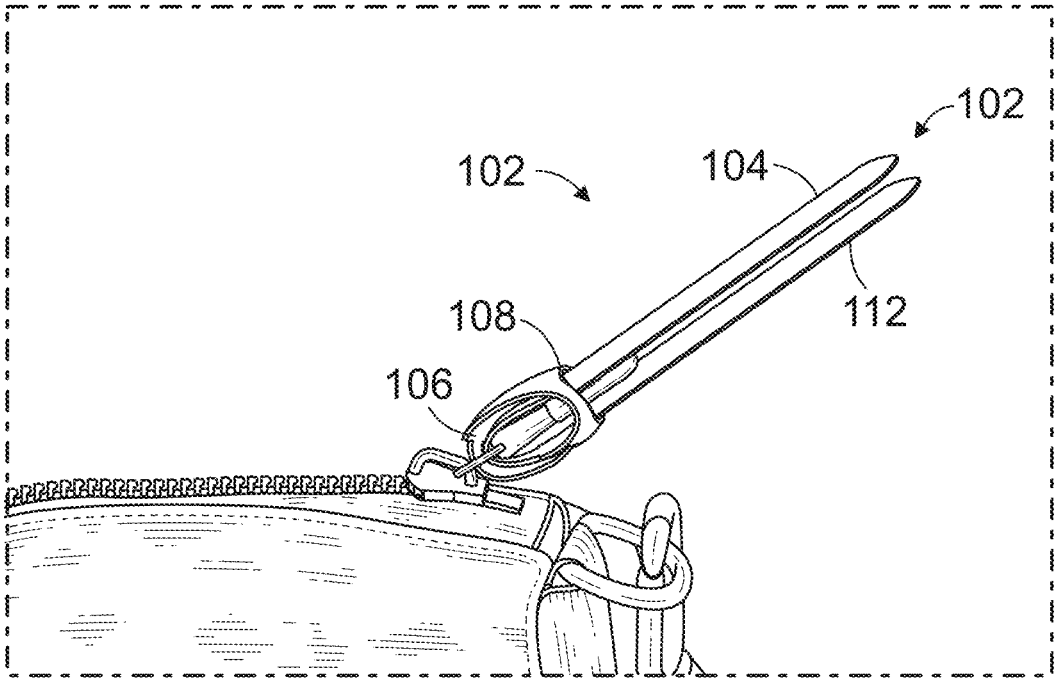
FIG. 19 illustrates an attached Pull-tab Extender according to an exemplary embodiment.

FIG. 19 illustrates an attached Pull-tab Extender according to an exemplary embodiment. The system comprises a Pull-tab Extender Embodiment 102, a First Elongated Tab 104, a Central Planar Body Element 106, a First Aperture 108, a Second Aperture 110, and a Second Elongated Tab 112. FIG. 19 is an illustration of the side view where the Pull-tab Extender is completely covering the zipper pull and the two tabs are able to meet at equidistant lengths after the folding and extending through the First Aperture 108 and Second Aperture 110. The zipper, as can be seen, is pulled through the First Aperture 108, indicating there is space in this embodiment within the First Aperture 108. In other embodiments, the zipper or pull-tab may not be pulled through First Aperture 108 and the First Aperture 108 may be proportionately narrower.

Figure 20:
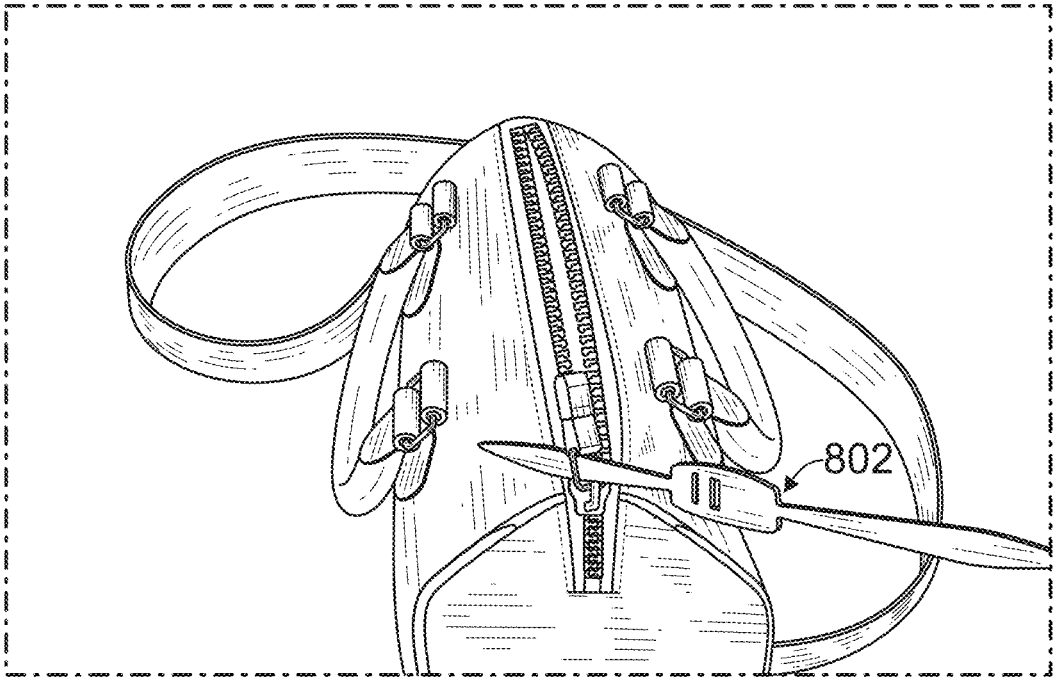
FIG. 20 illustrates an attachment method step according to another embodiment.

FIG. 20 illustrates an attachment method step according to another embodiment. The system comprises Pull-tab Extender Embodiment 802. As can be seen the tapered tabs of Pull-tab Extender Embodiment 802 can be sieved through the zipper pull aperture sideways, in order to fit, and then be weaved as in the process of FIG. 12-FIG. 19. In the case of a more narrow aperture in the zipper pull as well as tapered ends of the Pull-tab Extender, the Pull-tab Extender Embodiment 802 may be weaved sideways to fit through the aperture and then turned ninety degrees at the tapered end to continue looping and connecting.

Figure 21:
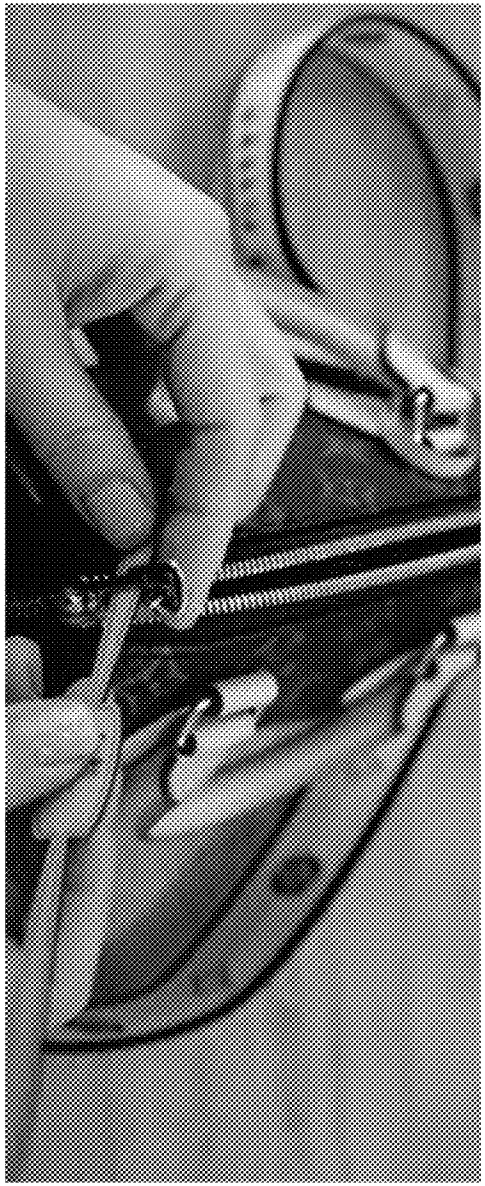
FIG. 21 illustrates a color image of an attachment method step according to another embodiment.

FIG. 21 illustrates a color image of an attachment method step according to another embodiment. The system comprises a Pull-tab Extender Embodiment 802. The color image of FIG. 21 illustrates the method described in FIG. 20. As can be seen turning the Pull-tab Extender sideways enables it to fit through and be pushed toward the tapered side for a more close fit. The process of FIG. 12-FIG. 19 may then be followed for tying or connecting the rest of Pull-tab Extender Embodiment 802 to a final product similar to FIG. 19.

Another exemplary embodiment may contain a plurality of magnets on the First Elongated Tab 104 and Second Elongated Tab 112. The magnets may be circular discs embedded in the tabs. There may be several discs used for clasping the two tabs once strung through the apertures. Similarly one or more rectangular magnets may be used running along all or part/parts of the lengths of the tabs, so that the tabs will clasp together and remain in place and aligned once woven through the apertures.

In yet another exemplary embodiment, velcro and/or reusable adhesive material may be used to achieve the better alignment of the two tabs. For example, velcro or a reattachable material may be placed along all or part of the tabs so that the alignment is achieved for the two tabs to rest closely attached or within close proximity along the same axis.

From the foregoing, it can be seen that there has been provided a detailed description and features for improved zipper pull attachments, as well as a disclosure of a method for attaching the Pull-tab Extenders. While particular embodiments of the present invention have been shown and described in detail, it will be obvious to those skilled in the art that changes and modifications may be made without departing from the invention in its broader aspects. Therefore, the aim here is to cover all such changes and modifications as fall within the true spirit and scope of the invention. The matters set forth in the foregoing description and accompanying drawings are offered by way of illustrations only, and not as limitations. The actual scope of the invention is to be defined by the subsequent claims when viewed in their proper perspective based on the prior art.

What is claimed is:

1. A pull-tab extender comprising:

a central planar body element having a proximal end and distal end, the central planar body element defining a first aperture and a second aperture thereon;

a first elongated tab at the distal end of the central planar body element;

a second elongated tab at the proximal end of the central planar body element and proximate to the second aperture, the first elongated tab being longer than the second elongated tab with the first elongated tab being positioned at the central planar body element closer to the first aperture than the second aperture, the first aperture being intermediate to the central planar body element; and wherein the second aperture can accommodate a thickness of the second elongated tab, and the first aperture can accommodate a thickness of both the first and second elongated tabs.

2. The pull-tab extender of claim 1 wherein the second aperture is at least as large as the thickness of the second elongated tab, and the first aperture is at least as large as the thickness of both the first and second elongated tabs.

3. The pull-tab extender of claim 1 wherein the first aperture is near centered relative to the central planar body element.

4. The pull-tab extender of claim 3 wherein the first elongated tab is looped back over the second elongated tab, into the second aperture and then into and through the first aperture.

5. The pull-tab extender of claim 4 wherein the first and second elongated tabs are at equal lengths when fully looped through the first and second apertures.

6. The pull-tab extender of claim 1 wherein the second elongated tab is looped back and into the first aperture.

7. The pull-tab extender of claim 1 wherein the central planar body element is enabled to be received at a pull-tab of a closure device and the pull-tab of the closure device is a zipper.

8. The pull-tab extender of claim 7 wherein the closure device fits through the first aperture as well as the first elongated tab and the second elongated tab.

9. The pull-tab extender of claim 1 wherein the first elongated tab and the second elongated tab are tapered toward the central planar body element.

10. The pull-tab extender of claim 1 wherein the pull-tab extender is made of an expandable material and the second aperture is expanded to accommodate the thickness of the second elongated tab, and the first aperture is expanded to accommodate the thickness of both the first and second elongated tabs.

11. The pull-tab extender of claim 1 wherein magnets are located within the first and second elongated tabs and are used to clasp the first elongated tab to the second elongated tab at a point of the magnets.

12. A pull-tab extender comprising:

a central planar body element having a proximal end and distal end, the central planar body element defining a first aperture and a second aperture thereon;

a first elongated tab at the distal end of the central planar body element;

a second elongated tab at the proximal end of the central planar body element and proximate to the second aperture, the first elongated tab being longer than the second elongated tab with the first elongated tab being positioned at the central planar body element closer to the first aperture than the second aperture, the first aperture being intermediate to the central planar body element; and wherein the second aperture can accommodate a thickness of the second elongated tab, and the first aperture can accommodate a thickness of both the first and second elongated tabs; and the second elongated tab is looped back and into the first aperture and the first elongated tab is looped back over the second elongated tab, into the second aperture and then into and through the first aperture.

13. The pull-tab extender of claim 12 wherein the first and second elongated tabs are at equal lengths when fully looped through the first and second apertures.

14. The pull-tab extender of claim 12 wherein the central planar body element is enabled to be received at a pull-tab of a closure device.

15. The pull-tab extender of claim 14 wherein the closure device fits through the second aperture as well as the first elongated tab and the second elongated tab.

16. A pull-tab extender method, comprising the steps of:

providing a planar body element having a proximal end and distal end;

defining a first aperture and a second aperture into and through the body element and positioned thereon, with the first aperture being positioned close to the proximal end of said body element, the second aperture being positioned intermediate said body element and closer to the distal end of said body element than the first aperture positioning relative to the distal end of said body element;

extending a first elongated tab from the proximal end of said body element; and extending a second elongated tab from the distal end of said body element, the second elongated tab being longer than the first elongated tab, wherein the second aperture being able to accommodate a thickness of both the first elongated tab and the second elongated tab.

17. The pull-tab extender method of claim 16, further comprising the steps of looping the second elongated tab into the first aperture and looping the first elongated tab over the second elongated tab, directing the first elongated tab into the second aperture and into the first aperture with the second elongated tab.

18. The pull-tab extender method of claim 17 wherein the first and second elongated tabs are at equal lengths when fully looped through the first and second apertures.

19. The pull-tab extender method of claim 17, wherein the looping steps of the first and second elongated tabs receives a pull-tab of a closure device at the body element for use therewith.

20. The pull-tab extender method of claim 16 wherein the extending steps of the respective first and second elongated tabs provide the first and second elongated tabs as integral with the body element.

* * * * *